US006363297B1

(12) United States Patent
Wienholt et al.

(10) Patent No.: US 6,363,297 B1
(45) Date of Patent: Mar. 26, 2002

(54) METHOD AND CIRCUIT FOR PREDICTING AND REGULATING A PAPER WINDING PARAMETER IN A PAPER WINDING DEVICE

(75) Inventors: Willfried Wienholt, München; Clemens Schäffner, Martinsried; Helmut Liepold, Gremsdorf, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/581,002

(22) PCT Filed: Dec. 1, 1998

(86) PCT No.: PCT/DE98/03531

§ 371 Date: Jun. 6, 2000

§ 102(e) Date: Jun. 6, 2000

(87) PCT Pub. No.: WO99/29604

PCT Pub. Date: Jun. 17, 1999

(30) Foreign Application Priority Data

Dec. 10, 1997 (DE) ..... 197 54 878

(51) Int. Cl.[7] ..... B65H 18/08; G06F 17/60

(52) U.S. Cl. ..... 700/126; 242/534; 706/21

(58) Field of Search ..... 700/126, 139; 242/520, 534, 534.2; 73/159; 706/21

(56) References Cited

U.S. PATENT DOCUMENTS

| | | | | |
|---|---|---|---|---|
| 4,594,880 A | | 6/1986 | Murdoch et al. | |
| 4,743,811 A | | 5/1988 | Katayama | |
| 5,308,010 A | * | 5/1994 | Hakiel | 700/126 X |
| 5,971,315 A | * | 10/1999 | Kojo | 242/534.2 |

FOREIGN PATENT DOCUMENTS

| | | |
|---|---|---|
| DE | 26 33 999 | 2/1978 |
| DE | 24 39 212 | 2/1980 |
| DE | 27 41 083 | 3/1983 |
| DE | 29 32 396 | 5/1988 |
| DE | 41 16 081 | 2/1995 |
| DE | 195 31 692 | 4/1996 |
| DE | 196 04 652 | 8/1997 |
| EP | 0 745 890 | 12/1996 |

OTHER PUBLICATIONS

Patent Abstracts of Japan: vol. 13, No. 434, (M–875), Sep. 28, 1989 & JP 01 167158 dated Jun 30, 1989.

* cited by examiner

*Primary Examiner*—Peter Nerbun
(74) *Attorney, Agent, or Firm*—BakerBotts LLP

(57) ABSTRACT

When winding a paper web, in order to achieve a constant reeling layer thickness, which represents a significant quality parameter in the production process of paper, the line force or the web tension of the paper is corrected as an influencing force. Using measurements, the relationship between force and layer thickness is determined and used to set a controller. In winding devices, winding from the parent reel generally takes place on a winding station, so that the invention makes use of the relationship between the winding and unwinding operation to the effect that the change in the layer thickness is measured and these measured values are used to train a predictor. In continuous operation, in order to regulate a paper winding device, a measured variable which can be registered is measured, and this measured variable is used to determine the layer thickness change or another correlated quality parameter. In order to compensate for the dead time which arises as a result of the measurement, the predictor is supplied with the specified quality parameters and predicts precisely that variable which will result after the dead time has elapsed, so that in relation to the measurement, the predicted value corresponds to the actual measured value. This variable is used to form the control difference and is fed to the controller, which calculates from it the correction force with which the actual desired influencing force of the paper winding device is corrected.

14 Claims, 4 Drawing Sheets

METHOD AND CIRCUIT FOR PREDICTING AND REGULATING A PAPER WINDING PARAMETER IN A PAPER WINDING DEVICE

BACKGROUND OF THE INVENTION

1. Field of the Invention

The invention relates to a method and arrangement for prediction and regulating a paper winding characteristic variable in a paper winding device to achieve a constant reeling layer thickness (improved quality) in the production process that controls the line force or the web tension.

2. Description of the Related Art

During the manufacture of paper, the paper is wound up, in webs up to 10 meters wide, onto a parent reel for intermediate storage and further processing. The diameter of the parent reel may be up to 3 meters or more. During further processing, this paper web runs through a slitter to be tailored to customer-specific specifications, and is cut into paper web widths of different width on the slitter and wound up onto cores which can be supplied to customers.

Paper-specific problems can occur in the production of these customer reels. The paper is reeled up onto the parent reel under tensile stress in the horizontal direction, and by pressing it in the radial direction of the sleeve. This reeling process introduces viscoelastic effects of the paper. The reeling-up mechanism impresses a wide variety of properties onto the paper, since the forces used in the process are stored in the layers of the parent reel.

As the paper is unwound from the parent reel onto another reel, it is again subjected to tangential and radial forces. The aim during this winding operation is to reel up the paper reel produced with an optimum winding hardness so that, in particular, no telescoping of the paper reel occurs, nor does any plastic deformation of the paper within the reel occur. Since the material characteristics of the wound paper vary from grade to grade, this is a very complex problem.

The reel hardness or the winding hardness is normally used as a measure for assessing the quality of the reel produced. For this paper winding characteristic variable there exist different definitions, of which one, for example, is the average layer thickness: during the reeling-up operation, the number of layers wound and the increase in radius are determined. In this way, the average layer thickness is obtained, which is normally averaged over 100 layers. In order to be able to compare the average layer thickness between individual paper grades better, this variable is related to the paper thickness in the unstressed state of the respective grade which gives a characteristic number that is generally less than 1. The lower it is, the harder the reel has been wound (i.e., it has a high winding hardness). In the other case, the average normalized layer thickness is relatively high, which corresponds to a low winding hardness. These variables are normally plotted against the diameter as illustrated, for example, in FIG. 2. Depending on whether reeling up or unwinding is concerned, one may speak of reeling or unwinding curves or else of reeling layer thickness curves. The course of such a curve provides information about the quality of the reel produced. It generally exhibits sharp fluctuations, which make an interpretation in relation to the quality considerably more difficult. In practice, a reel is designated as optimally wound if the reeling curve has a virtually constant course, with the exception of the start and end of the winding operation. The mean value of the curve is used for assessment.

In a manner similar to the reel winding hardness, a reel unwinding hardness in relation to the parent reel is defined.

It can be seen from the curves in FIG. 2 that the reel winding curve (AU) and the reel unwinding curve (AB) influence each other. Furthermore, it can be seen that despite the force relationships being regulated to be constant during the winding operation, the course of the reeling curve follows the unwinding curve of the parent reel. However, as outlined at the beginning, such a behavior of the paper reel during the reeling-up operation is not desired.

SUMMARY OF THE INVENTION

The problem on which the invention is based is therefore to specify a method and an arrangement with which a paper winding characteristic variable which is critical during the paper winding operation can be predicted and/or regulated.

This object is achieved by a method of predicting a paper winding characteristic variable in a paper winding device, comprising the steps of:

a) unwinding paper from a first paper reel and winding the paper onto a second paper reel;

b) determining, in a preparatory step, depending on a measurable time-dependent characteristic variable of the step of winding at a known first influencing force at least the first paper winding characteristic variable of the first paper reel and a second paper winding characteristic variable of the second paper reel, the first paper winding characteristic variable and the second paper winding characteristic variable being results of the preparatory step;

c) setting a predictor that predicts a future second paper winding characteristic variable, utilizing the results of the preparatory step which are a function of the first and the second paper winding characteristic variable, and a time variable This object is also achieved by a method of regulating a paper winding characteristic variable in a paper winding device via influencing forces which influence the paper winding characteristic variable, comprising the steps of:

a) unwinding paper from a first paper reel and winding the paper onto a second paper reel under the influence of one of the influencing forces;

b) determining, in a first preparatory step, depending on at least one measurable time-dependent characteristic variable of the step of winding at a constant first influencing force, a first paper winding characteristic variable of the first paper reel and a second paper winding characteristic variable of the second paper reel, the first paper winding characteristic variable and the second paper winding characteristic variable at the first influencing force being results of the first preparatory step;

c) determining, in a second preparatory step, depending on at least the measurable characteristic variable of the step of winding at a known second influencing force, a second paper winding characteristic variable and a time duration for this determination operation, as a determination time, the second paper winding characteristic variable and the time duration at the second influencing force being results of the second preparatory step;

d) setting a predictor that predicts a future second paper winding characteristic variable, utilizing the results from the first preparatory step, as a function of the second paper winding characteristic variable, and a time variable;

e) setting a controller that regulates, as a function of the second paper winding characteristic variable provided to it, an influencing force associated with the second paper winding characteristic variable, utilizing the results of the first preparatory step and the second preparatory step;

f) providing the controller, during a control operation, a desired second paper winding characteristic variable, using the second paper winding characteristic variable on the paper winding device as an actual paper winding characteristic variable, determining a predicted paper winding characteristic variable using a determination time and the actual paper winding characteristic variable, and regulating an influencing force of the control operation by providing a control difference which is formed with the predicted paper winding characteristic variable being used together with the desired second paper winding characteristic variable.

This object is also achieved by an arrangement for predicting a paper winding characteristic variable in a paper winding device, comprising:

a) a first and a second paper reel, paper being unwound from the first paper reel and wound up onto the second paper reel;

b) a predictor which has been set to predict a future second paper winding characteristic variable using results from a preparatory step, the preparatory step determining, depending on a measurable time-dependent characteristic variable of paper being wound up onto the second paper reel, a first paper winding characteristic variable of the first paper reel and a second paper winding characteristic variable of the second paper and a time variable;

c) a determining mechanism for determining the paper winding characteristic variable from the measurable time-dependent characteristic variable; and d) a measuring device for measuring the paper winding characteristic variable.

Finally, this object is achieved by an arrangement for regulating a paper winding characteristic variable in a paper winding device via an influencing force which influences the paper winding characteristic variable, comprising:

a first and at least a second paper reel, paper being unwound from the first paper reel and wound up onto the second paper reel, which constitute a winding operation, under the influence of the influencing force;

a predictor which has been set to predict a future second paper winding characteristic variable using results from a first preparatory step, the first preparatory step determining, depending on at least one measurable time-dependent characteristic variable of the winding operation at a known first influencing force at least a first paper winding characteristic variable of the first paper reel and a second paper winding characteristic variable of the second paper reel and a determination time;

a determining mechanism for determining the paper winding characteristic variable from the measurable time-dependent characteristic variable within the determination time;

a measuring device for measuring the paper winding characteristic variable;

a controller which has been set using results from the first and the second preparatory steps, the preparatory steps determining, depending on at least the measurable time-dependent characteristic variable of the winding operation at a known second influencing force, at least the second paper winding characteristic variable and a time duration for a determination operation as the determination time, the controller regulating, as a function of the paper winding characteristic variable fed to it, an influencing force associated with the paper winding characteristic variable, predefining a desired second paper winding characteristic variable during a regulation operation, determining the second paper winding characteristic variable on the paper winding device by the determining mechanism as an actual paper winding characteristic variable, and the predictor predicting the paper winding characteristic variable with the determination time, and the the actual paper winding characteristic variable as the predicted paper winding characteristic variable which is used, together with the desired second paper winding characteristic variable, to form a control difference which is fed to the controller to regulate the influencing force.

Advantageously, when different paper reels are being unwound and wound, the behavior of the paper and of the associated paper winding characteristic variables is similar. Use may be made of this fact in order to train a predictor or to impress this behavior on it, in order to be able to predict the behavior of the paper winding characteristic variable for future winding operations.

Advantageously, the result of the prediction of the paper winding characteristic variable can be used to influence the forces, which are normally kept constant in paper winding devices, in accordance with the desired paper winding characteristic variable, by the behavior of the paper winding characteristic variable. This behavior depends on the influencing force, which is impressed on a controller and this controller being fed with a control difference formed from the desired winding characteristic variable and the predicted actual paper winding characteristic variable. The controller uses these variables to determine a compensation force, which is superimposed on an influencing force which is critical during the winding operation.

Advantageously, the method and the arrangement can also be employed when the paper is being wound from a larger reel onto smaller reels and, at the same time, the paper is being slit into webs.

Advantageously, for the case in which a wide paper web is being slit and wound up onto narrower paper reels, the result of the various predicted actual paper winding characteristic variables can be superimposed to form a common variable, in order to drive the controller.

Advantageously, when the proposed method is used, or the proposed arrangements are employed, simple measured variables, such as the radius of the paper or the angular velocity of the different paper reels, are registered in order to predict the actual paper winding characteristic variable or to determine the layer thickness from these variables.

Particularly advantageously, the proposed methods and arrangements can be employed both for regulating the line force and for regulating the web tension as the influencing force.

Advantageously, neural networks can be used as the predictor and PID controllers as the controller, since there is sufficient experience with these devices and no great expenditure is required for training or adapting these devices to specific problems during paper winding.

Advantageously, the proposed arrangements can be used in paper-reel slitters, since these have high quality requirements and an improvement can be achieved by way of the proposed methods.

Advantageously, the proposed method and the proposed arrangement can also be used in paper-like materials which have similar mechanical characteristics (i.e., a viscoelastic behavior and an elastic/plastic deformation like paper).

BRIEF DESCRIPTION OF THE DRAWINGS

Exemplary embodiments of the invention are explained further with reference to figures.

DESCRIPTION OF THE PREFERRED EMBODIMENTS

Figure 1:
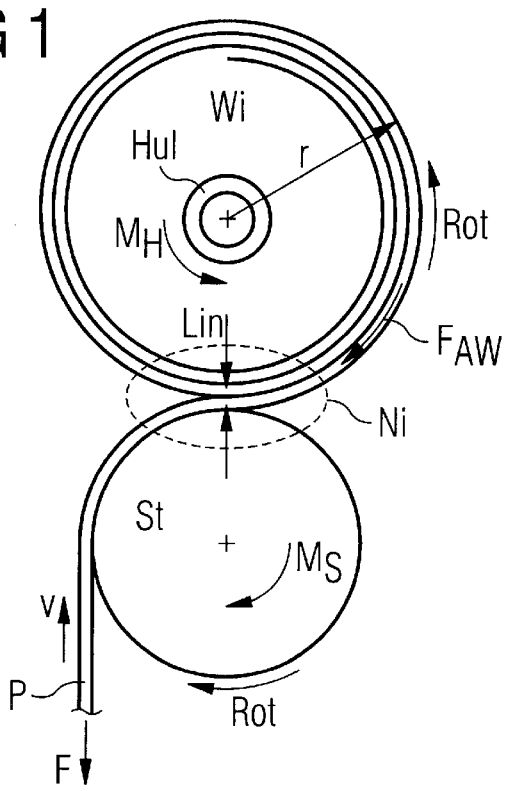
FIG. 1 is a schematic representation of a carrier-roll winder.

FIG. 1 shows, schematically, the structure of a carrier-roll winder with the radius r as the winding radius, F as the web tension upstream of the carrier roll St, and the web speed v. The paper web is designated by P, and $F_{AW}$ designates the wound-in web tension or else the force of the web on the reel. $M_H$ designates the drive torque of the center drive of the winding core, and $M_S$ designates the drive torque of the carrier roll, the reel being designated by Wi and the core by Hul. At the point of contact between the two rolls, which is also referred to as the nip Ni, a line force Lin occurs, which can be influenced with mechanical devices. A number of paper layers have already been wound one above another onto the reel Wi, which is indicated by concentric circles. In FIG. 1, the first paper reel, which represents the parent reel, is not illustrated, merely the second paper reel Wi, onto which the paper web P is being wound up. The first paper reel, from which paper is being unwound, is located upstream in the direction of the force F and essentially corresponds to the second reel, but is distinguishable from the latter by its width.

In paper winding devices, such as are particularly used in paper-reel slitters, the conditions in the nip, in which the two sides of the paper are contacted by the various rolls, play a special role for the criteria of the quality that can be achieved. Here, the web force $F_{AW}$ depends on the control variables and on further influencing variables, those of the paper and of the surroundings. Control variables are, for example, the drive torques $M_S$ of the carrier roll St and of the center drive $M_H$, the line force Lin with which the reel Wi is pressed onto the carrier roll St, the web tension upstream of the nip F, and, in some cases, friction damper settings, with which vertical movements of the reel Wi on the carrier roll St are damped by hydraulic dampers or by eddy-current brakes. Influencing variables are represented, for example, by the paper characteristics, such as the modulus of elasticity, the weight per unit area as related to the density, the roughness, the smoothness, the moisture, the porosity and the elongation at break of the paper. Likewise, it is also necessary to take into account, for example, from the carrier-roll characteristics the papers roughness and friction, as well as geometric data such as the paper web widths.

Figure 2:
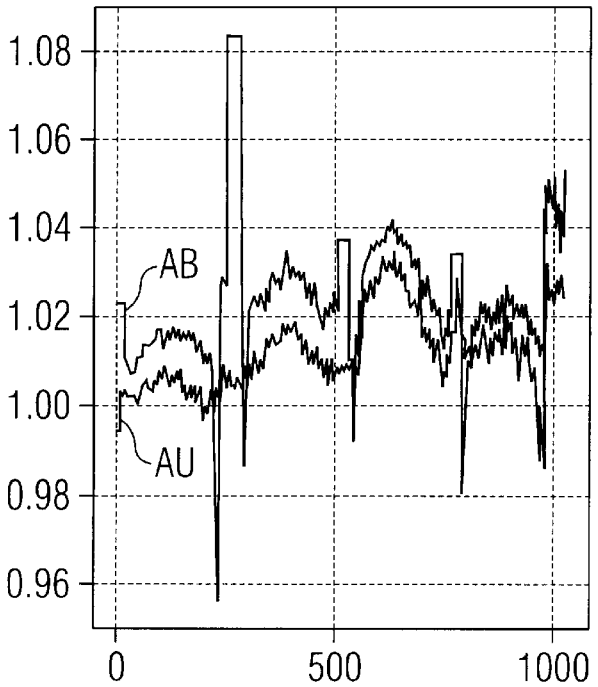
FIG. 2 is a chart showing reeling and unwinding curves.

As FIG. 2 shows, the course of a reeling layer thickness curve AU follows the course of the unwinding layer thickness curve AB of the parent reel. On the vertical axis, the normalized reeling layer thickness and unwinding layer thickness are plotted to the right of the diameter of the paper reel (horizontal axis) onto which paper is being reeled up. It is clearly possible to see that the reeling layer thickness curve AU models the course of the unwinding layer thickness curve of the parent reel, although in the case of current methods, the influencing force, which may be the line force or the web tension, is kept constant. There are treatments which describe the influence of the forces during the winding operation: W. Wolfermann "Mathematischer Zusammenhang zwischen Bahnzugkraft und inneren Spannungen an Wickeln von elastischen Bahnen." [Mathematical relationship between web tension and internal stresses in reels of elastic webs]dissertation at the Technical University of Munich 1976; H. J. Schaffrath "Über das Kompressions-Reibverhalten von Papier vor dem Hintergrund des Rollenwickelns" [The compression/friction behavior of paper against the background of reeling], dissertation at the Technical University of Darmstadt, 1993. In this reference, a mathematically functional relationship is produced between the web tension and physical variables which describe the state of the wound paper, such as, for example, the average layer thickness, winding hardness, and tangential and radial stresses. In these studies, however, the starting point consisted of idealized preconditions, for which reason forecasting the winding hardness in the real operation is not possible with the aid of these models on their own. In particular, the effects at the nip, the point at which the pressure rolls etc. press the paper onto the core of the reel, are neglected. By employing the present methods and arrangements, therefore, the invention seeks to achieve a constant course of this paper winding characteristic variable, or for an impressed desired course of this paper winding characteristic variable to be predefinable. In practice, paper winding devices which occur particularly frequently are slitters on which manufactured paper which has been stored on parent reels is cut to size in a customer-specific way. Such machines have a large number of adjustment possibilities and parameters, which are represented below:

- Machine data: edge trim, web tension curve number, braking time, reeler number, weight per unit area, maximum speed, turn-out number, paper grade, friction damper curve number, speed curve number, trim;
- Reel data: core diameter, diameter of the reel, average winding hardness, curve number, length of the reel, knife number, reel number, station number, width of the reel;
- Parent reel data: parent reel remaining diameter, a parent reel remaining length, parent reel number;
- Curve messages: (basic/desired and actual curves) station-independent curves: web tension, speed, friction damper pressure, compensation pressure (internal/external), current at main drive, current at brake generator, parent reel winding hardness, pressure rolls contact pressure (internal/external); Station-specific curves: reeling station cylinder pressure, pressure rolls contact pressure, center drive torque, winding hardness;
- Date, errors, state messages, time of day.

The machine data contain general information about the winding operation. The reel data are preferably provided for each reel produced. Curve messages provide information about desired and actual curves. Essentially, these are the web tension, speed and line force curves. In this case, for slitters having a number of stations, a distinction is drawn between curves which are identical for all the stations and those which are specific to a station. The measurable data on these paper winding devices are at present provided as a function of the diameter, but providing them as a function of the time or of other measured variables of the device is also conceivable.

In preparatory steps, in order to draw up the proposed arrangement or the proposed method, data has to be registered and collected from paper winding devices in operation. If the curves for the unwinding and reeling were, in this case, measured at discrete diameters, the diameter relating to the sample n is defined by $$d(n)=d_0+n\cdot\Delta d \tag{1}$$

Figure 3:
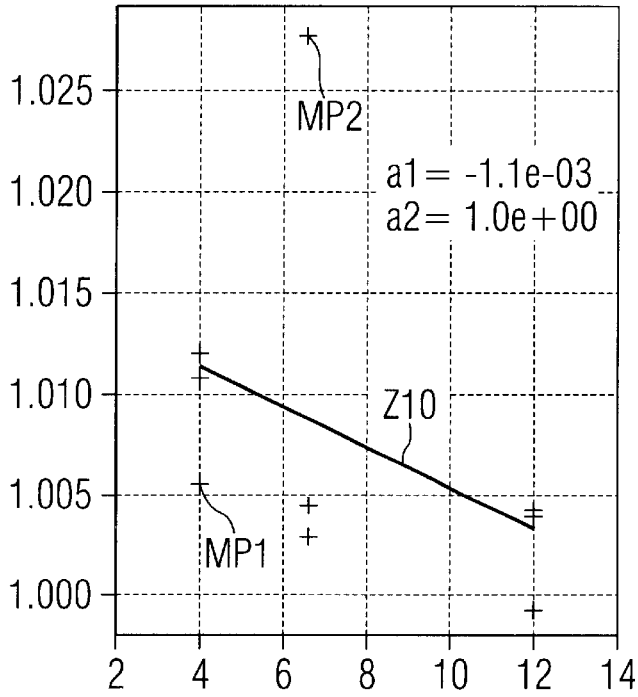
FIGS. 3 and 4 are charts showing force/layer thickness relationships
Figure 4:
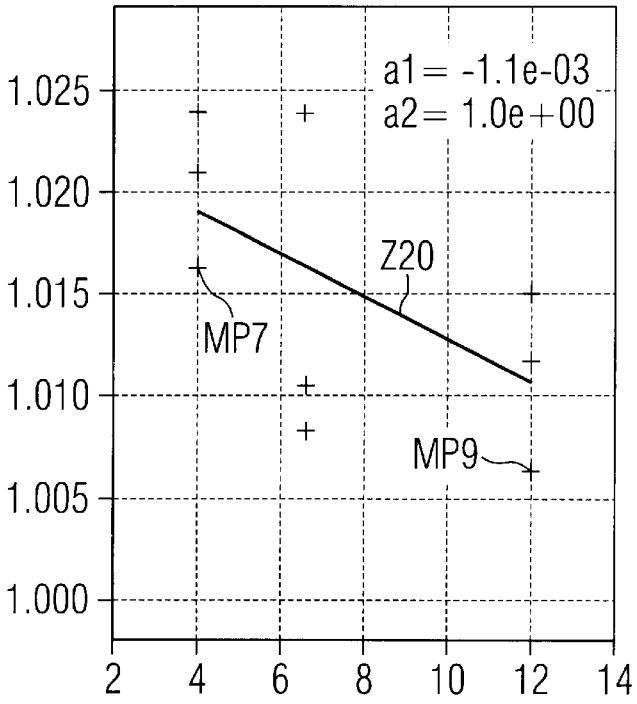

$\Delta d$ designates the diameter increment. In a similar way y(n) then signifies, for example, the value of the reeling curve at the diameter d(n). As FIGS. 3 and 4 show, there is a relationship between the influencing force and the reeling layer thickness. In this case, the web tension was investigated as the influencing force. However, similar courses are also conceivable using the line force as the influencing force.

FIGS. 3 and 4 show, by way of example, the courses of different stations of a paper slitter. The influencing force, i.e., the web tension, is plotted on the horizontal axis and the average layer thickness is plotted on the vertical axis. Investigations on real paper winding devices, i.e., measurements and recording of the values, result in measurement points MP1, MP2, MP7 and MP9. For reasons of clarity, not all the measurement points are designated here. The result of these investigations is a relationship Z10 and Z20, respectively, which can be used for regulating the paper winding characteristic variable, (in this case, the averaged normalized layer thickness), using an influencing force. In particular, for this purpose, the reeling curves for various web tensions are determined individually as a function of various paper grades and for various stations. If the mean value of these curves is plotted as a function of the web tension, then the result, to a first approximation, is a trend straight line which characterizes the decrease in the average layer thickness with increasing web tension, which corresponds to the observation that the winding hardness increases with increasing web tension. These trend straight lines are designated by Z10 and Z20 here. In this case, the following relationship results:

$$\overline{Y}(F)=a_1F+a_2 \tag{2}$$

Here, $\overline{Y}(F)$ signifies the averaged reeling layer thickness at the web tension F. The slope $a_1$ is negative. It should be noted here that this functional relationship is independent of the diameter. For later use in a controller, the inverse relationship is needed, which specifies the way in which the web tension depends on the averaged reeling layer thickness:

$$F(\overline{Y}) = \frac{\overline{Y} - a_2}{a_1} \tag{3}$$

In the general case, and particularly for the case in which no linear relationship can be detected, and therefore no simple formation of the inverse function is possible either, these measurement points are fed to a neural network or another function approximator as a function of the influencing force, and this network or approximator is trained with the corresponding relationship. In the process, the neural network $NN_1$ learns the relationship between force and average layer thickness or other paper winding characteristic variable by adapting its parameters w on the basis of these data and by way of known learning methods, on the basis of the equation:

$$F(\overline{Y})=NN_1(\overline{Y},w) \tag{4}$$

This relationship is also the basis for the control behavior of the controller described later.

From the observation already presented in FIG. 2, that the characteristics of the unwinding process are reproduced in the reeling-up process, it is possible to define a predictor, particularly a neural predictor, which uses the curve data of the reeling and unwinding at an actual diameter, and/or a different measurable characteristic variable d(n), to predict the value for reeling at the diameter $d(n+\Delta)$. The predictor can also consistently use other/further characteristic data as influencing variables. This means that it predicts the actual reeling layer thickness as the paper winding characteristic variable. Using x(n) as the unwinding layer thickness at the diameter d(n), and y(n) as the reeling layer thickness and z(n) as a state variable, it is possible to draw up a neural network with this nonlinear relationship, in the form:

$$\hat{y}^{(i)}(n+\Delta)=NN_2(x(n),y^{(i)}(n),z^{(i)}(n),w^{(i)} \tag{5}$$

between the future reeling layer thickness at the diameter $d(n+\Delta)$ and the actual diameter d(n) at the station i. Here, $w^{(i)}$ signifies the parameters of the neural network $NN_2$. The index ^ signifies an estimated value, i the number of the station, if a number of winding stations are employed, and $\Delta$ a value correlated with time. The result of investigations also shows that a simpler approximation can be used:

$$\hat{y}^{(i)}(n+\Delta)=w_1^{(i)}x(n)+w_2^{(i)}y^{(i)}(n)+w_3+z^{(i)}(n+\Delta) \tag{6}$$

$$z^{(i)}(n+\Delta)=z^{(i)}(n)+w_4^{(i)}[y^{(i)}(n)-\hat{y}^{(i)}(n)] \tag{7}$$

$$z^{(i)}(0)=\ldots=z^{(i)}(\Delta-1)=0 \tag{8}$$

These must be used to determine the parameters $w_2^{(i)}$ for the respective stations i. This is generally done by minimizing a cost function with the aid of a gradient method, and the values of the measured unwinding and reeling curves relating to the different turn-outs, (winding operations). These data are preferably organized by paper grades, and, within the paper grades, by the stations used. However, the special structure of the neural network permits a simplified, two-stage procedure. In a first step, z(n) is set 0 for all n and, by solving the resulting (over-determined) multilinear system of equations, the parameters $w_1^{(i)}$ through $w_3^{(i)}$ are calculated. Known standard methods, such as the singular-value decomposition, for example, can be used for this purpose. In a further step, the parameter $W_4^{(i)}$ is then determined in such a way that the remaining residual error of the multilinear model is minimized.

The individual predictions $\hat{y}^{(i)}(n+\Delta)$ are preferably combined with the aid of a further neural network $NN_3$ to form one characteristic variable, if a number of paper winding stations are used in the reeling-up operation.

$$\hat{y}(n+\Delta)=NN_3(\hat{y}^{(i)}(n+\Delta)) \tag{9}$$

$$\hat{y}(n+\Delta)=\text{Mean}\{\hat{y}^{(i)}(n+\Delta)|\text{Station i active}\} \tag{10}$$

$$\hat{y}(n+\Delta)=\text{Max}\{\hat{y}^{(i)}(n+\Delta)|\text{Station i active}\} \tag{11}$$

This measure corresponds to a specific implementation of a "mixing of experts" with neural networks. In this case, each predictor constitutes a station-specific neural expert in relation to the reeling layer thickness or another paper winding characteristic variable, and an input variable for the controller is formed from the contributions from all the experts. Since all of the stations are not always active during a winding operation, or in the extreme case only one station is operated, it is preferable if only the contributions of the active stations are taken into account.

Figure 6:
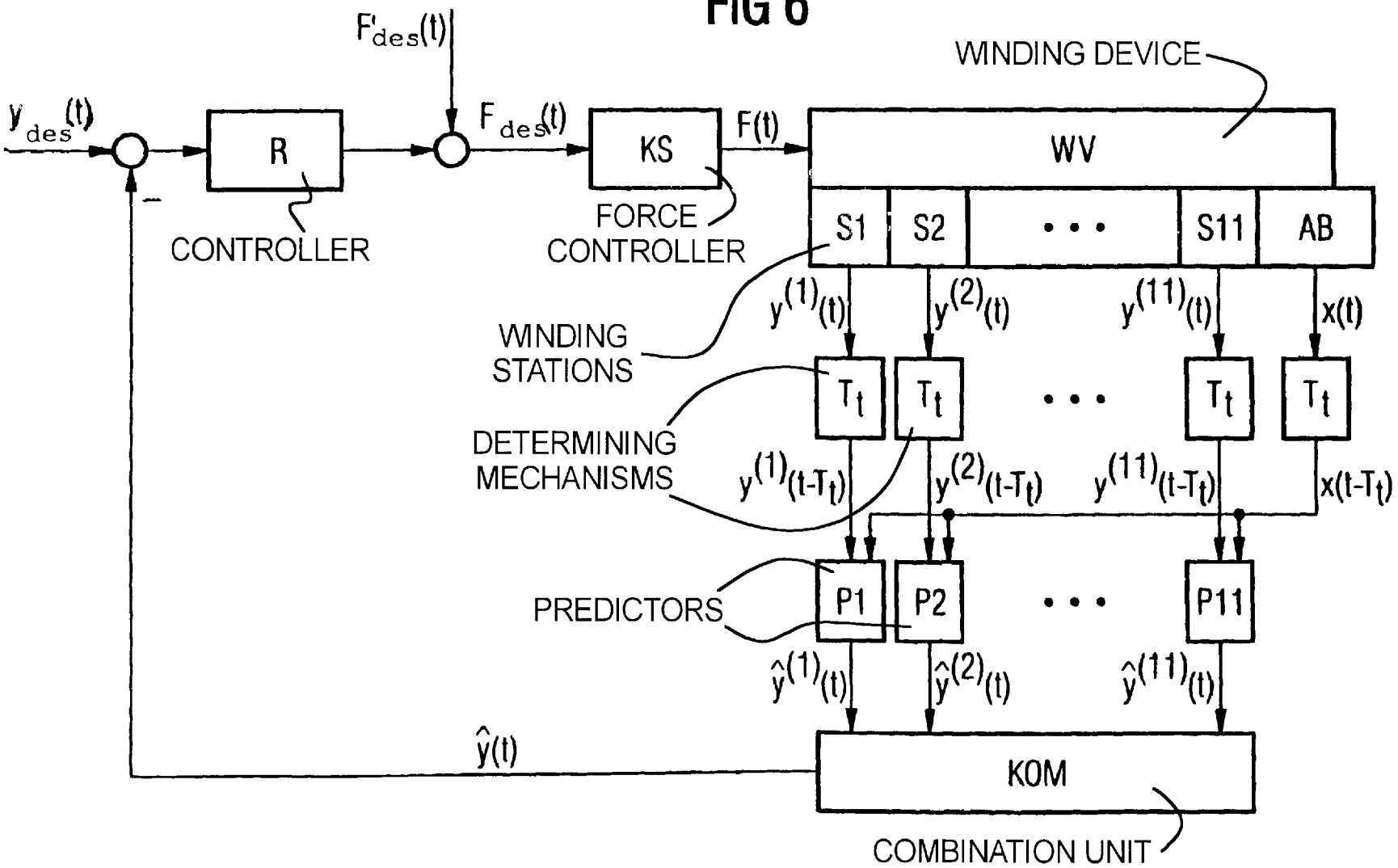
FIG. 6 is a block schematic diagram showing a control loop for a number of winding stations.

As FIG. 6 shows, the predicted value $\hat{y}$ serves as an estimate of the reeling value at the diameter d or another time-correlated variable. This predicted value (first occurrences), in addition to the desired value preset for the paper winding characteristic variable $Y_{des}$ and the desired value preset of the web tension $F'_{des}$, is preferably processed during the control operation. In this case time was used as an argument here and, in order to simplify the representation, a time delay $T_t$ has been assumed for the relevant stages of the control loop. Since, however, at the present time both the measurements and the model for the predictor are related discretely to a diameter, the diameter-prediction horizon $\Delta$ has to be selected in such a way that the time delay is compensated for in the individual stages.

The controller R is fed, for example, a control difference between the desired value preset $Y_{des}$ and the estimated value $\hat{y}(t)$. It is designed, for example, as a PID controller and makes use of the relationship, which was determined at the beginning, between the force and average layer thickness as the paper winding characteristic variable. The desired force $F'_{des}(t)$ predefined for a force controller KS is preferably corrected by the controller R. Accordingly, by varying the influencing force $F_{des}(t)$ of the force controller KS at the individual winding stations S1 to S11 of the winding device WV, a desired reel layer thickness or a desired reel layer thickness variation during the winding operation is achieved. For this purpose, measured values are registered at the individual stations S1 to S11 for the winding and at the unwinding station of the parent reel AB, and used to determine a layer thickness as a function of a dead time $T_t$, this dead time being needed for determining or calculating the influencing variable from the measured variables. Accordingly, predictors P1 to P11 are provided which are fed these determined influencing variables and which predict an actual layer thickness at the current time. This means that the dead time which elapses in order to determine the influencing variables from the measured variables is compensated for by the predictors. If more than one station is provided, as illustrated here in FIG. 6, a combination unit KOM is employed, which superimposes the individual predicted results in a suitable way to form an estimated value $\hat{y}(t)$. The force controller KS is already of the prior art in current paper winding devices, and is used to keep the set force $F_{des}(t)$ constant. In the proposed controller R, a correction force is determined for the force $F'_{des}(t)$. Here, the controller uses the relationship of Formula 3, which for this purpose may be presented as follows:

$$\delta F(n)=NN_1(\hat{y}(n))-NN_1(Y_{des}(n)) \tag{12}$$

$$F_{des}(n)=F'_{des}(n)+\delta F(n) \tag{13}$$

In the case of a linear relationship, for the correction, for example, it is true that:

$$\delta F(n) = \frac{\hat{y}(n) - y_{des}(n)}{a_1} \tag{14}$$

The web tension correction, or the correction of the line force as the influencing force, compensates for the observed fluctuations in the reeling curve, since if there is an increase in value of the reeling layer thickness, the web tension is increased, and if there is a decrease in reeling layer thickness in comparison with the desired value, the web tension is reduced. Because of the mechanical characteristics of the paper, i.e., those caused by the process, the web tension correction may not exceed or fall below specific values. For this reason, a limitation is preferably to be provided, and can be implemented, for example, by way of hard limits in accordance with:

$$F_{des}(n) = \begin{cases} F_{\min} & F_{des}(n) < F_{\min} \\ F_{des}(n) & F_{\min} \le F_{des}(n) \le F_{\max} \\ F_{\max} & F_{des}(n) > F_{\max} \end{cases}$$

or else by soft limits, which are characterized by a limiting function which can be differentiated, for example, on the basis of the arctan function. In the case of more complicated relationships, the use of a neural network as a limiter is also conceivable.

According to the present arrangement, therefore, a desired paper winding characteristic variable is corrected by way of a predicted paper winding characteristic variable and, in the controller R, which regulates the way in which the influencing force depends on the paper winding characteristic variable, a desired correction force is produced which corresponds to the control difference between the predicted actual paper winding characteristic variable and the desired paper winding characteristic variable. Using this correction force, the force control system KS, which regulates the influencing force of the winding device WV, has a corrected desired force $F'_{des}(t)$ predefined, in order to regulate the paper winding characteristic variable at the individual winding stations or the second paper reels S1 to S11. In some cases, more or fewer winding stations can also be provided on the winding device. Likewise, it is not necessary for predictors to be provided for each winding device, but in some cases it is possible to record and use, to predict an estimated variable, only the measured values from those winding stations of which it is known that they lie at the upper or at the lower end of the scatter of the quality parameters of the winding process. This means that it is preferable if a particularly good and, respectively, a particularly poor station are selected. As can be in seen, in the case of this winding device in FIG. 6, the influencing force is regulated in the same way for all of the winding stations. However, cases are also conceivable in which the influencing forces can be regulated separately for each winding station. In the case of such arrangements, the control arrangement from FIG. 5 can be used. The influencing force used here for regulating the winding device can be both the line force and the web tension.

Figure 5:
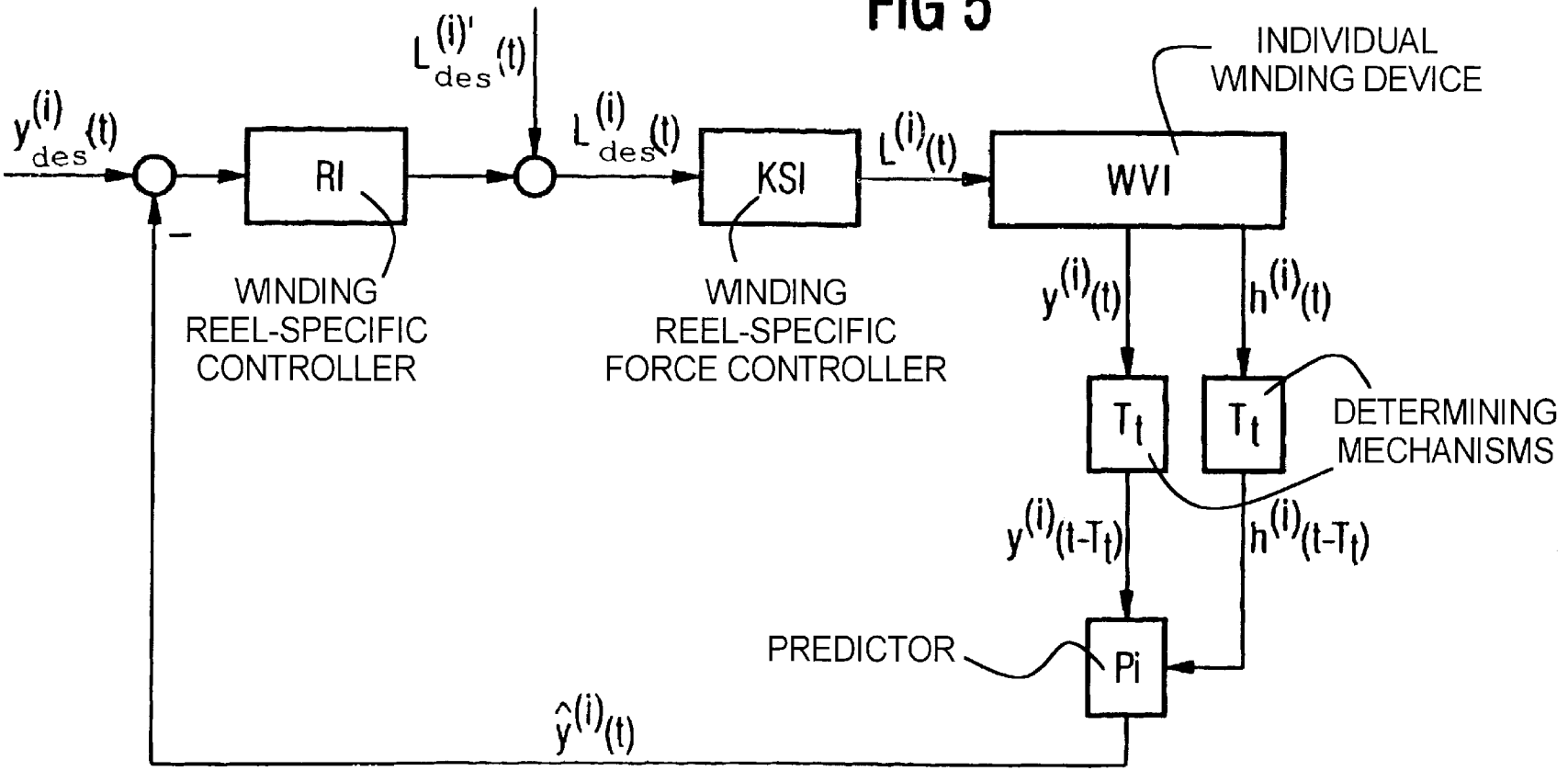
FIG. 5 is a block schematic diagram showing a control loop for a winding station

FIG. 5 shows the regulation of the line force in a winding device. Related to the FIG. 6 description, the web tension can also be regulated in a corresponding way, but without restricting the invention, provided the web tension of individual winding stations F1 to F11 can be regulated separately. The representation in FIG. 5 differs from that in FIG. 6 merely by the fact that, instead of the web tension F, a line force L is entered, and that winding-reel-specific controllers RI and KSI, respectively are provided. In a similar way to the known function from FIG. 6, this controller, or this control arrangement, is used to regulate a predefined desired paper winding characteristic variable by way of a correction force which influences the preset force for the force controller KSI and which has been derived from a predicted estimated value $\hat{y}^{(i)}(t)$ in order to form the control difference which is fed to the controller. In FIG. 5, WVI designates the individual, separate winding device. It is possible that, in addition to the described regulation of the reeling layer thickness as the paper winding influencing variable by way of the web tension, a further improvement can be achieved if the line force is likewise regulated, or the line force in combination with the web tension is regulated. The characteristic factor in this case is that the desired line force $L'_{des}$ is influenced and corrected by the controller RI, and that the force control loop which is already present on the winding device and regulates the influencing force $L^{(i)}(t)$ can be used without any change, so that no change to existing paper winding devices is necessary. The latter are usually capable of regulating a constant influencing force during the winding operation. In a way similar to that used when regulating utilizing the web tension as the influencing force, first the way in which the average reeling layer thickness depends, as the paper winding influencing variable, on the line force as the influencing force is determined and approximated by a linear trend straight line, and; the relationship is learned by a function approximator. The predictor $P_i$ is set by using the known relationships between the unwinding of the parent reel and the reeling of the paper reel. This means that measurements with different forces likewise have to be performed in the preliminary stages and plotted in a similar way to that which was done in FIG. 2 for the line force.

The above-described method is illustrative of the principles of the present invention. Numerous modifications and adaptions thereof will be readily apparent to those skilled in this art without departing from the spirit and scope of the present invention.

We claim:

1. A method of predicting a paper winding characteristic variable in a paper winding device, comprising the steps of:

a) unwinding paper from a first paper reel and winding said paper onto a second paper reel;

b) determining, in a preparatory step, depending on a measurable time-dependent characteristic variable of said step of winding at a known first influencing force, a first paper winding characteristic variable of said first paper reel and a second paper winding characteristic variable of said second paper reel, said first paper winding characteristic variable and said second paper winding characteristic variable being results of said preparatory step;

c) setting a predictor that predicts a future second paper winding characteristic variable, utilizing said results of said preparatory step which are a function of said first and said second paper winding characteristic variable, and a time variable.

2. A method of regulating a paper winding characteristic variable in a paper winding device via influencing forces which influence said paper winding characteristic variable, comprising the steps of:

a) unwinding paper from a first paper reel and winding said paper onto a second paper reel under the influence of one of said influencing forces;

b) determining in a first preparatory step, depending on a measurable time-dependent characteristic variable of said step of winding at a constant first influencing force, a first paper winding characteristic variable of said first paper reel and a second paper winding characteristic variable of said second paper reel, said first paper winding characteristic variable and said second paper winding characteristic variable at said first influencing force being results of said first preparatory step;

c) determining, in a second preparatory step, depending on a measurable characteristic variable of said step of winding at a known second influencing force, a second paper winding characteristic variable and a time duration for this determination operation, as a determination time, said second paper winding characteristic variable and said time duration at said second influencing force being results of said second preparatory step;

d) setting a predictor that predicts a future second paper winding characteristic variable, utilizing said results from said first preparatory step, as a function of said second paper winding characteristic variable, and a time variable;

e) setting a controller that regulates, as a function of said second paper winding characteristic variable provided to it, an influencing force associated with said second paper winding characteristic variable, utilizing said results of said first preparatory step and said second preparatory step;

f) providing said controller, during a control operation, a desired second paper winding characteristic variable, using said second paper winding characteristic variable on said paper winding device as an actual paper winding characteristic variable, determining a predicted paper winding characteristic variable using a determination time and said actual paper winding characteristic variable, and regulating an influencing force of said control operation by providing a control difference which is formed with said predicted paper winding characteristic variable being used together with said desired second paper winding characteristic variable.

3. The method as claimed in claim 1, further comprising the steps of:

slitting said paper into webs as it is wound; and winding said paper onto at least two second paper reels.

4. The method as claimed in claim 2, further comprising the step of forming a common paper winding characteristic variable by processing results of multiple ones of said predictor.

5. The method as claimed in claim 1, wherein said paper winding characteristic variable used is a layer thickness of said paper.

6. The method as claimed in claim 2, wherein one of said influencing forces regulated is selected from the group consisting of a line force and a web tension.

7. An arrangement for predicting a paper winding characteristic variable in a paper winding device, comprising:

a) a first and a second paper reel, paper being unwound from said first paper reel and wound up onto said second paper reel;

b) a predictor which has been set to predict a future second paper winding characteristic variable using results from a preparatory step, said preparatory step determining, depending on a measurable time-dependent characteristic variable of paper being wound up onto said second paper reel, a first paper winding characteristic variable of said first paper reel and a second paper winding characteristic variable of said second paper reel and a time variable;

c) a determining mechanism for determining each said paper winding characteristic variable from said measurable time-dependent characteristic variable; and d) a measuring device for measuring each said paper winding characteristic variable.

8. An arrangement for regulating a paper winding characteristic variable in a paper winding device via an influencing force which influences said paper winding characteristic variable, comprising:

a first and a second paper reel, paper being unwound from said first paper reel and wound up onto said second paper reel, which constitute a winding operation, under the influence of said influencing force;

a predictor which has been set to predict a future second paper winding characteristic variable using results from a first preparatory step, said first preparatory step determining, depending on a measurable time-dependent characteristic variable of said winding operation at a known first influencing force, a first paper winding characteristic variable of said first paper reel and a second paper winding characteristic variable of said second paper reel and a determination time;

a determining mechanism for determining each said paper winding characteristic variable from said measurable time-dependent characteristic variable within said determination time;

a measuring device for measuring each said paper winding characteristic variable;

a controller which has been set using results from said first and said second preparatory steps, said preparatory steps determining, depending on said measurable time-dependent characteristic variable of said winding operation at a known second influencing force, a second paper winding characteristic variable and a time duration for a determination operation, as said determination time, said controller regulating as a function of each said paper winding characteristic variable fed to it, an influencing force associated with each said paper winding characteristic variable, predefining a desired second paper winding characteristic variable during a regulation operation, determining said second paper winding characteristic variable on said paper winding device by said determining mechanism as an actual paper winding characteristic variable, and said predictor predicting each said paper winding characteristic variable with said determination time, and each said the actual paper winding characteristic variable as each said predicted paper winding characteristic variable which is used, together with said desired second paper winding characteristic variable, to form a control difference which is fed to said controller to regulate said influencing force.

9. The arrangement as claimed in claim 7 further comprising a neural network.

10. The arrangement as claimed in claim 8, wherein said controller is a PID controller.

11. The method as claimed in claim 2, further comprising the steps of:

slitting said paper into webs as it is wound; and winding said paper onto at least two second paper reels.

12. The method as claimed in claim 1, wherein said measurable time-dependent characteristic variable used is selected from the group consisting of an angular velocity of a paper reel and a radius of a paper reel.

13. The method as claimed in claim 1, wherein said predictor used is a neural network.

14. The arrangement as claimed in claim 8 further comprising a neural network.

* * * * *